US006499906B1

(12) United States Patent
Zheng

(10) Patent No.: US 6,499,906 B1
(45) Date of Patent: Dec. 31, 2002

(54) PIVOT JOINT FOLDABLE FURNITURE

(75) Inventor: Edward Zheng, La Verne, CA (US)

(73) Assignee: Tofasco of America, La Verne, CA (US)

( * ) Notice: Subject to any disclaimer, the term of this patent is extended or adjusted under 35 U.S.C. 154(b) by 0 days.

(21) Appl. No.: 09/662,793

(22) Filed: Sep. 15, 2000

(51) Int. Cl.[7] ..... A61F 2/43

(52) U.S. Cl. ..... 403/65; 403/52; 403/1.5; 403/119; 292/16.2

(58) Field of Search ..... 403/52, 53, 65, 403/119, 150, 157, 159; 297/16.2

(56) References Cited

U.S. PATENT DOCUMENTS 5,458,647 A * 10/1995 Brochier et al. ..... 403/157 X
5,975,626 A * 11/1999 Aycock ..... 297/16.2 X
6,270,156 B1 * 8/2001 Metzger et al. ..... 297/16.2

FOREIGN PATENT DOCUMENTS

| | | |
|---|---|---|
| EP | 0 821 912 A2 | 3/1998 |
| JP | 1-265835 | 10/1989 |
| JP | 10-275236 | 10/1998 |

* cited by examiner

*Primary Examiner*—Lynne H. Browne
*Assistant Examiner*—John R. Cottingham
(74) *Attorney, Agent, or Firm*—Raymond Y. Chan; David & Raymond Patent Group

(57) ABSTRACT

A pivot joint has a tail portion and a head portion securely affixed thereto wherein the head portion of the pivot joint has at least an engaging slot for pivotally connecting a guest tube frame of the foldable furniture and the tail portion of the pivot joint is adapted for rotatably affixing on a host tube frame of the foldable furniture in such a manner that the guest tube frame is adapted to rotate in various directions with respect to the host tube frame.

9 Claims, 7 Drawing Sheets

PIVOT JOINT FOLDABLE FURNITURE

BACKGROUND OF THE PRESENT INVENTION

1. Field of Invention

The present invention relates to foldable furniture, and more particularly to a foldable furniture employed with a pivot joint which is adapted to pivotally connect tube frames together, so as to increase the flexibility of the tube frames for further extending the foldable furniture.

2. Description of Related Arts

Conventional pivot joints are commonly used in foldable furniture such as chair or table such that the foldable furniture is adapted to be folded into a compact unit for storage and carriage or unfolded for use.

Such pivot joint is adapted for pivotally connecting at least two tube frames together such that each tube frame can pivotally rotate about the pivot joint, so as to fold up and unfold the foldable furniture. However, such pivot joint can only provide each tube frame to rotate in one dimension, which will limit the flexibility of folding furniture for further extension. In other words, when two tube frames are connected with the pivot joint, each tube frame can only pivotally rotate in single direction. For example, a base pivot joint of the foldable furniture is pivotally connected with two bottom ends of two tube frames respectively wherein each tube frame can be rotated in one dimension with respect to the pivot joint such that the base pivot joint will limit the size and shape of the foldable furniture in an unfolded state.

Moreover, each pivot joint has a relatively bigger size for pivotally connecting with the tube frames such that when the foldable furniture is folded up, the bulky pivot joints will take up much spaces in such a manner that the foldable furniture cannot ready to fold up into a compact unit.

SUMMARY OF THE PRESENT INVENTION

A main object of the present invention is to provide a pivot joint for foldable furniture, which is adapted to pivotally connect tube frames together, so as to increase the flexibility of the tube frames for further extending the foldable furniture.

Another object of the present invention is to provide a pivot joint for foldable furniture, wherein the tube frames can pivotally rotate about the pivot joint in all directions.

Accordingly, in order to accomplish the above objects, the present invention provides a pivot joint for foldable furniture which constructed with a plurality of host and guest tube frames wherein the pivot joint has a tail portion and a head portion securely affixed thereto wherein the head portion of the pivot joint has at least an engaging slot for pivotally connecting the guest tube frame and the tail portion of the pivot joint is adapted for rotatably affixing on the foldable furniture such as the host tube frame or a frame joint in such a manner that the guest tube frame is adapted to rotate in various directions with respect to the foldable furniture.

DETAILED DESCRIPTION OF THE PREFERRED EMBODIMENT

Figure 1:
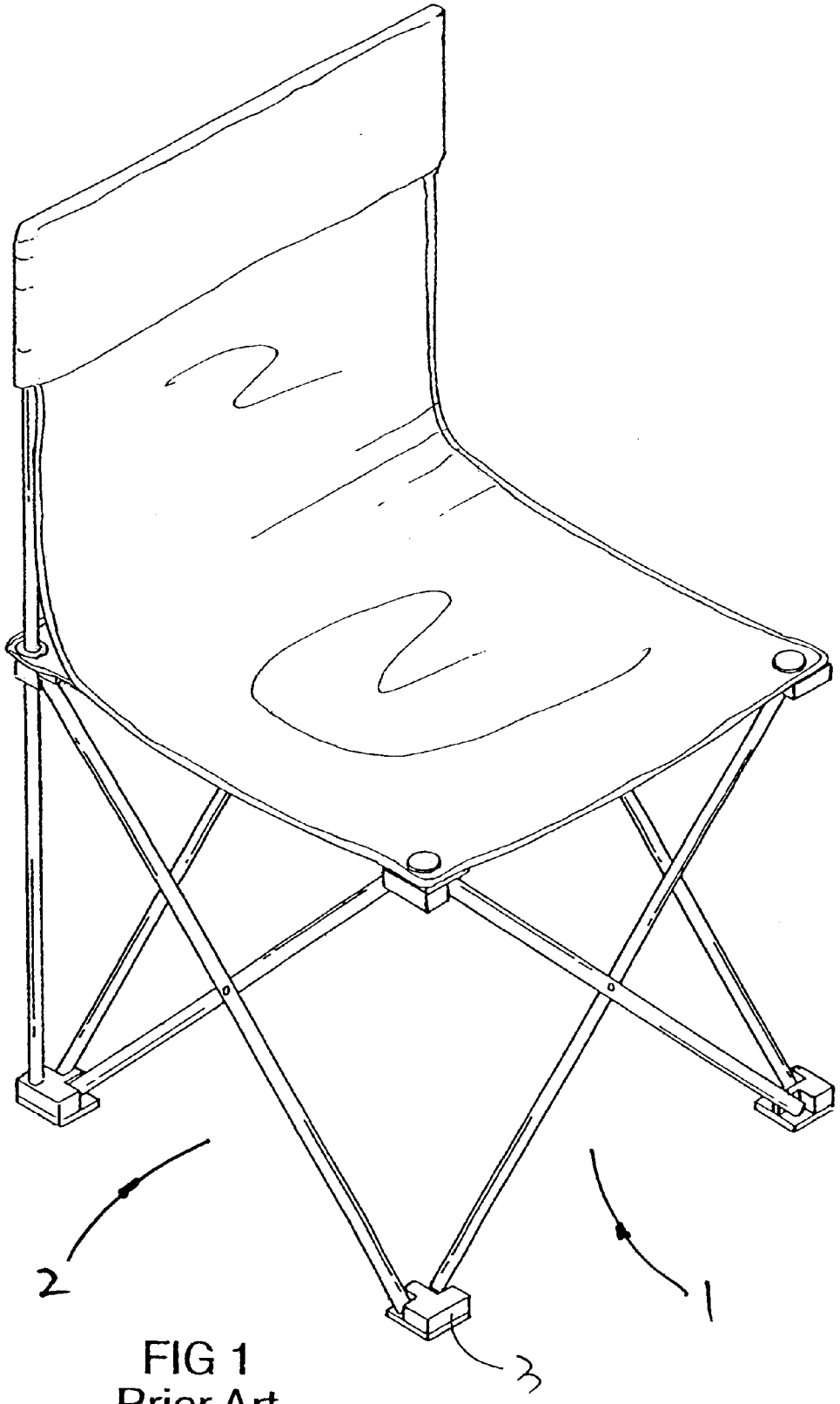
FIG 1 Prior Art
FIG. 1 is a perspective view of a foldable furniture.

Referring to FIG. 1 of the drawings, a conventional foldable furniture is illustrated, wherein the foldable furniture is constructed with a plurality of host tube frames 1 and a plurality of guest tube frames 2 pivotally connected together such that when the foldable furniture is folded up, the host tube frames 1 and the guest tube frames 2 are pivotally rotated together, so as to fold into a compact unit.

Figure 2:
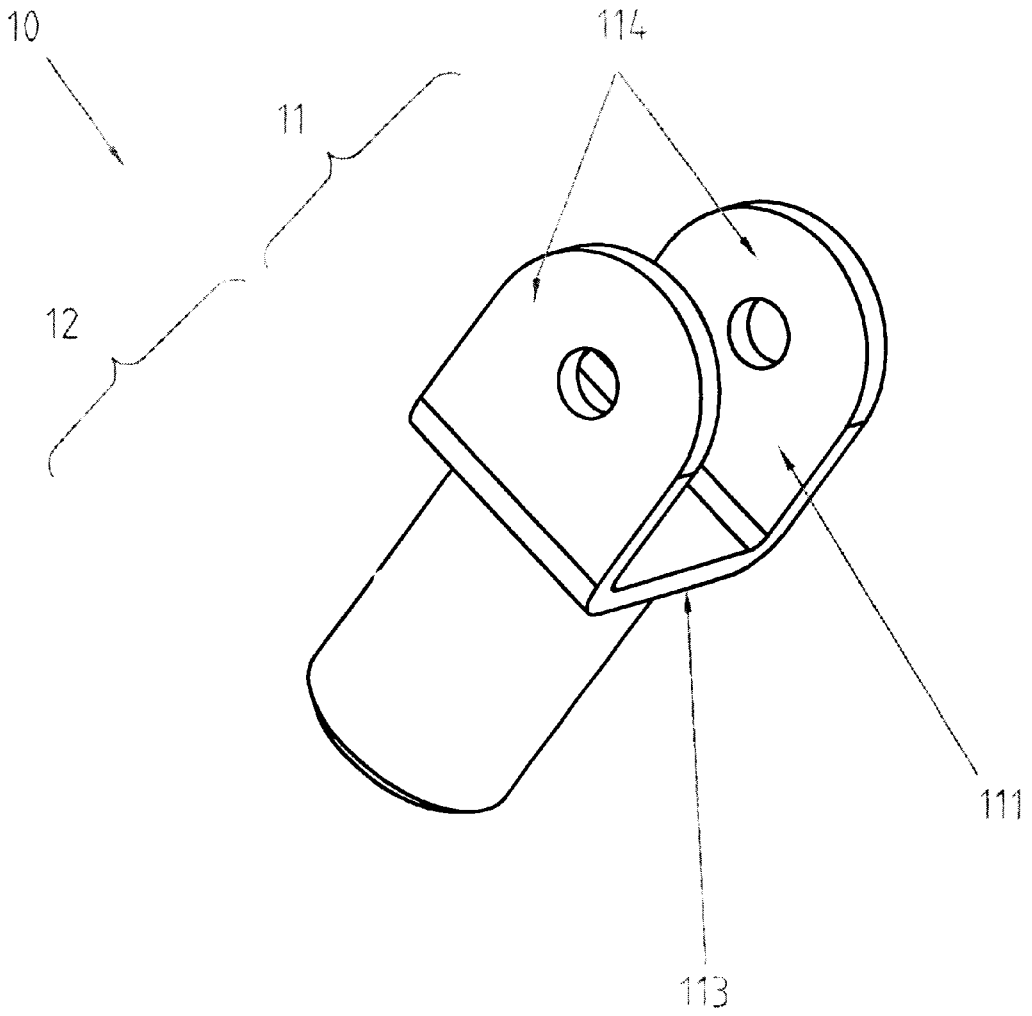
FIG. 2 is a perspective view of a pivot joint according to a preferred embodiment of the present invention.

As shown in FIG. 2, a pivot joint 10 according to a preferred embodiment of the present invention is illustrated, wherein the pivot joint 10 is adapted for pivotally connecting the host tube frame 1 with the guest tube frame 2.

The pivot joint 10 has a head portion 11 and a tail portion 12 securely affixed thereto wherein the head portion 11 of the pivot joint 10 has at least an engaging slot 111 for pivotally connecting the guest tube frame 2 and the tail portion 12 of the pivot joint 10 is adapted for rotatably affixing on the host tube frame 1 in such a manner that the guest tube frame 2 is adapted to rotate in various directions with respect to the host tube frame 1.

Figure 3:
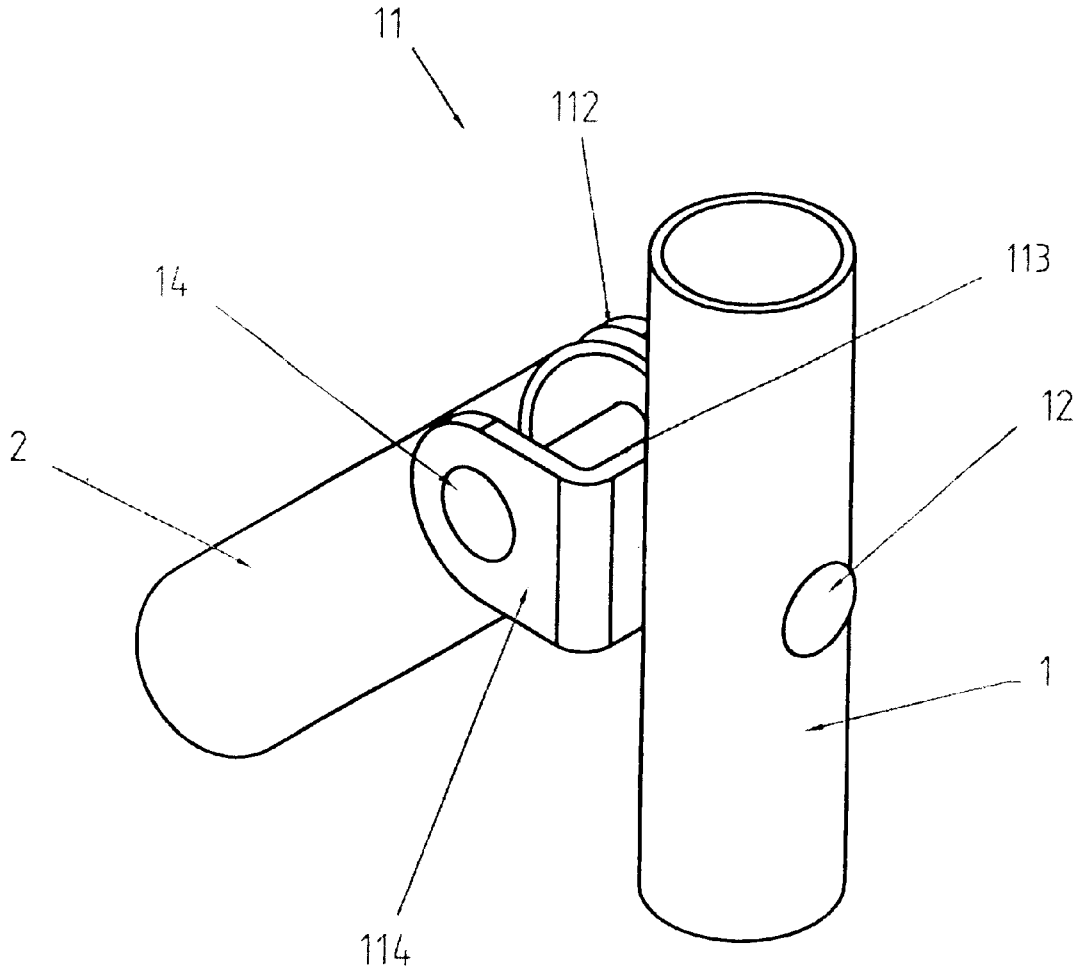
FIGS. 3 to 5 illustrate various applications of the pivot joint according to the above preferred embodiment of the present invention.

Accordingly, as shown in FIG. 3, the head portion 11 of the pivot joint 10 having a U shape comprises a supporting panel 113 and a pair of parallel supporting walls 114 integrally and upwardly extended therefrom wherein the engaging slot 112 is defined between the two supporting walls 114 such that an end portion of the guest tube frame 2 is pivotally connected between the two supporting walls 114 by means of an axle 14.

The tail portion 12 of the pivot joint 10 comprises a rod like shaft body 121 perpendicularly affixed at the supporting panel 113 of the head portion 11 wherein the shaft body 121 is adapted for transversely and rotatably penetrating through the host tube frame 1 in such a manner the pivot joint 10 is adapted for transversely affixing on the host tube frame 1 and pivotally connecting with the guest tube frame 2. In other words, two tube frames (the host tube frame 1 and the guest tube frame 2 are pivotally connected together by the pivot joint 10. Preferably, the tail portion 12 of the pivot joint 10 is a rivet which is adapted to securely affix on the host tube frame 1 in such rotatably movable manner.

It is worth to mention that the guest tube frame 2 is adapted for pivotally rotating along the engaging slot 112 of the head portion 11 of the pivot joint 10 wherein the tail portion 12 thereof is rotatably affixed on the host tube frame 1 such that the guest tube frame 2 is adapted for pivotally rotating at three dimensions with respect to the host tube frame 1.

Figure 4:
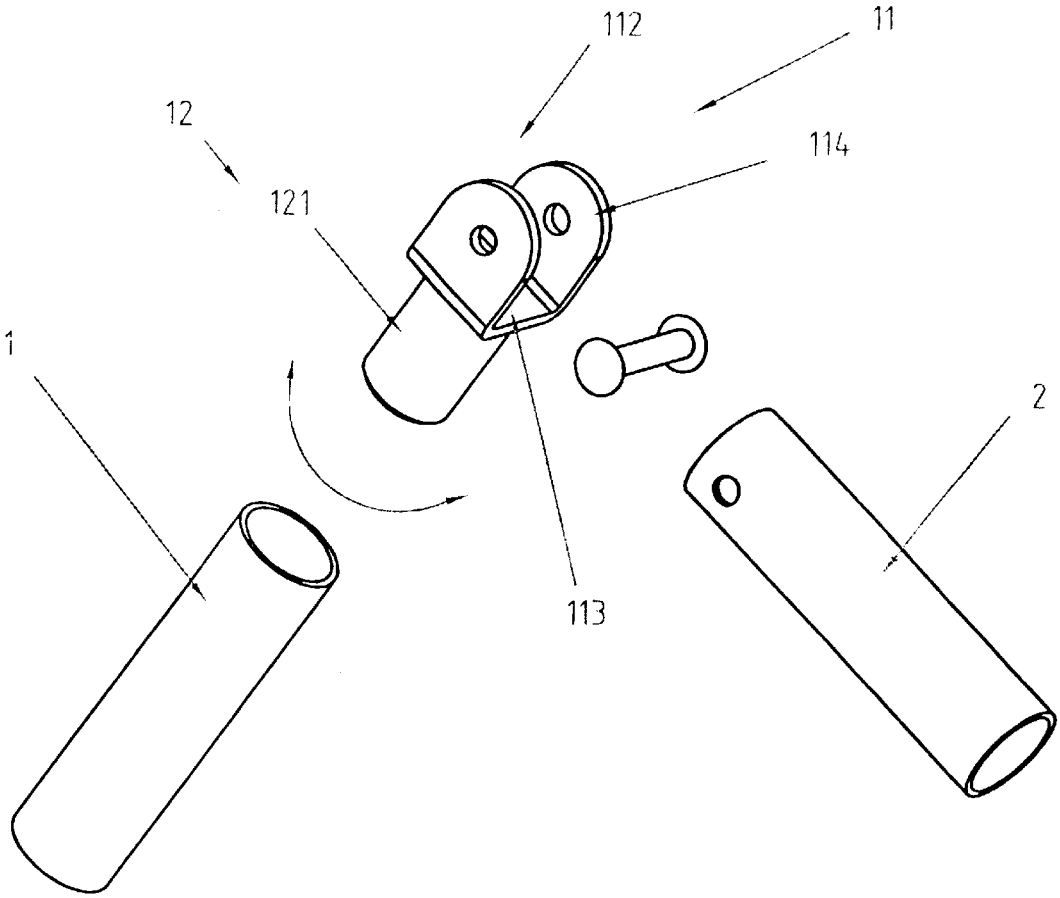

Alternatively, various applications of the pivot joint 10 can be utilized in the foldable furniture. The tail portion 12 of the pivot joint 10 is adapted for coaxially affixing on the host tube frame 1. The host tube frame 1 has a hollow body which has a diameter slightly larger than the tail portion 12 of the pivot joint 10 in such a manner the tail portion 12 thereof is fittingly inserted into the host tube frame 1 at one end thereof, as shown in FIG. 4.

Moreover, the pivot joint 10 is adapted for pivotally connecting between a base joint 3 of the foldable furniture and the guest tube frame 2. Accordingly, the base joint 3 of the foldable furniture comprises a base panel 3A for stabilizing the foldable furniture in the unfolded state.

Figure 5:
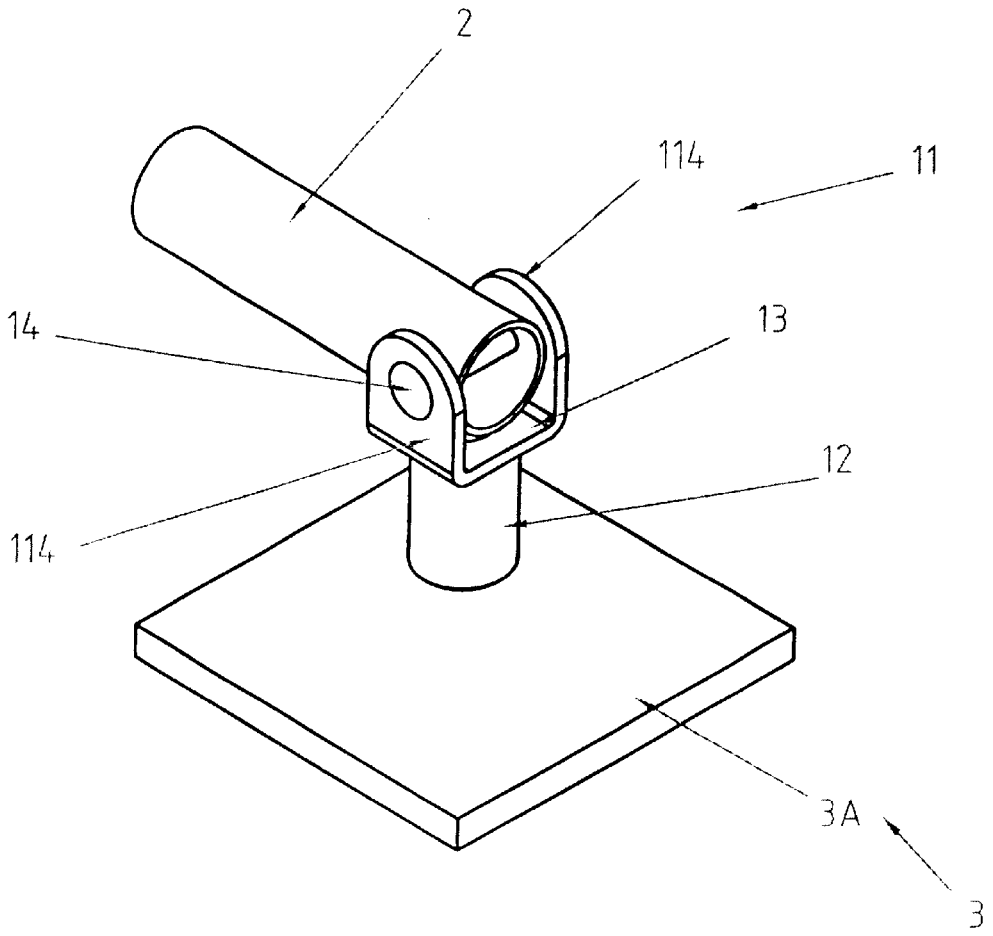

As shown in FIG. 5, the tail portion 12 of the pivot joint 10 is vertically and upwardly affixed on the base panel 3A of the base joint 3 wherein the guest tube frame 2 is pivotally connected with the head portion 11 of the pivot joint 10. The base joint 3 equipped with the pivot joint 10 is adapted for increasing the rotating angle of the guest tube frame 2, especially for a foldable beach chair which provides a low height frame structure. Thus, the pivot joint 10 is capably of being employed with any frame joint of the foldable furniture for increasing the rotating angle of the tube frame in order to construct a better extension of the foldable furniture as it is mentioned above.

Figure 6:
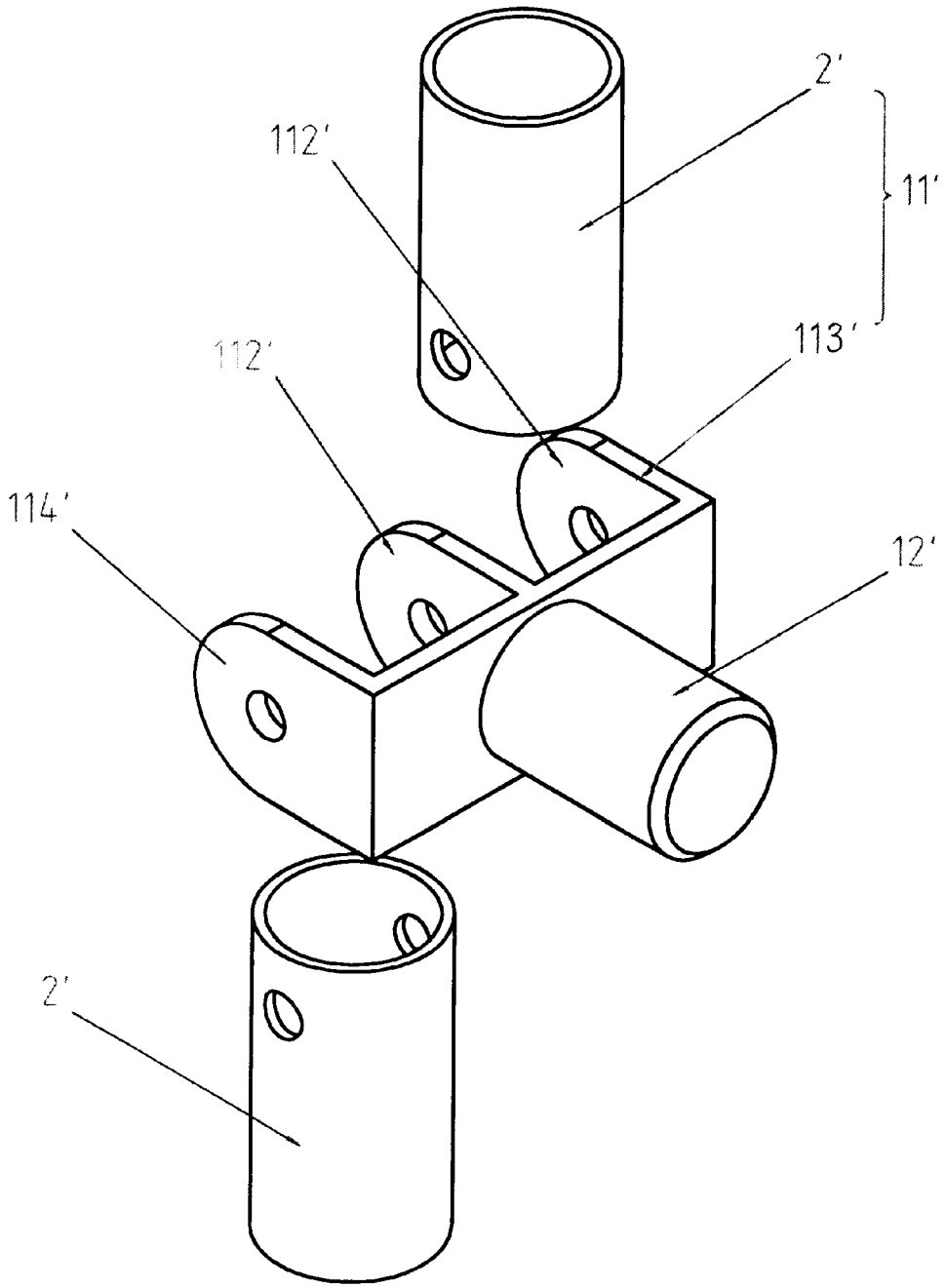
FIG. 6 illustrates a first alternative mode of the pivot joint according to the above preferred embodiment of the present invention.

FIG. 6 illustrates a first alternative mode of the pivot joint 10', which comprises a head portion 11' and a tail portion 12', according to the preferred embodiment of the present invention, wherein the head portion 11' has two engaging slots 112' for pivotally connecting two guest tube frames 2' respectively.

The head portion 11' of the pivot joint 10' having a W shape comprises a supporting panel 113' and three parallel supporting walls 114' integrally and upwardly extended therefrom wherein the two engaging slots 112' are defined between the three supporting walls 114' respectively such that the two guest tube frames 2' are pivotally connected between the three supporting walls 114' and along said two engaging slots 112' respectively in such rotatably movable manner by means of an axle. In other words, the two guest tube frames 2' are disposed in the two engaging slots 112' respectively in such a manner the host frame 1 is adapted for pivotally connecting two guest tube frame 2' by the pivot joint 10'.

Figure 7:
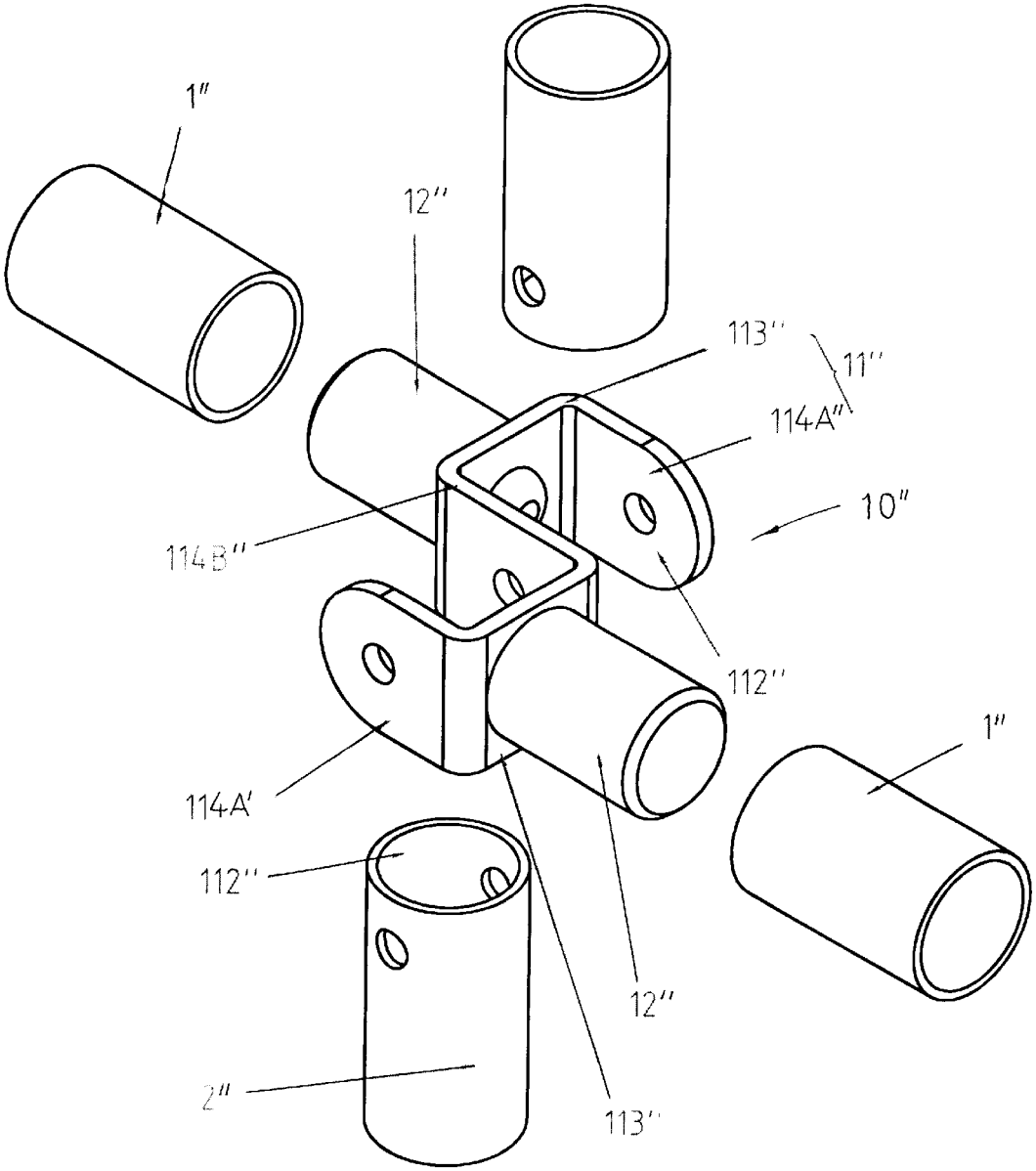
FIG. 7 illustrates a second alternative mode of the pivot joint according to the above preferred embodiment of the present invention.

FIG. 7 illustrates a second alternative mode of the pivot joint 10" according to the preferred embodiment of the present invention, wherein the pivot joint 10" is adapted for pivotally connecting two host tube frames 1" and two guest tube frames 2" together.

The pivot joint 10" has the head portion 11" having two outer supporting walls 114A" and an intermediate supporting wall 114B" parallel to the two outer supporting walls 114A" wherein two supporting panels 113" are integrally connected between the outer supporting walls 114A" and the intermediate supporting wall 114B" to form a S shape structural head portion 11", as shown in FIG. 7. Thus, two opposed engaging slots 112" are defined between the outer supporting wall 114A" and the intermediate supporting wall 114B" respectively.

The pivot joint 10" further has two tail portions 12" rotatably connected to the two supporting panels 113" respectively wherein the two tail portions 12" of the pivot joint 10" are opposedly and parallelly extended from the head portion 11" thereof. So, the pivot joint 10" is adapted for pivotally connecting two host tube frames 1" which are securely affixed to the tail portions 12" respectively with two guest tube frames 2" which are pivotally connected along the two engaging slots 112" of the head portion 11".

While the foregoing description and figures describe the preferred embodiment and its alternative modes of the present invention, it should be appreciated that certain obvious modifications, variations, and substitutions may be made without departing from the spirit and scope of the present invention.

What is claimed is:

1. A pivot joint for foldable furniture which is constructed with a plurality of host and guest tube frames, wherein said pivot joint has a tail portion and a head portion securely affixed thereto, said head portion of the pivot joint having at least an engaging slot for pivotally connecting said guest tube frame and said tail portion of the pivot joint adapted for connecting to said foldable furniture in such a manner that said guest tube frame is adapted to rotate in various directions with respect to said foldable furniture; wherein said head portion of said pivot joint having a U shape comprises a supporting panel and a pair of parallel supporting walls integrally and upwardly extended therefrom wherein said engaging slot is defined between said two supporting walls such that an end portion of said guest tube frame is pivotally connected between said two supporting walls by means of an axle; wherein said tail portion, which is a rivet, comprises a shaft body securely affixed on said supporting panel of said head portion, wherein said shaft body is adapted for transversely and rotatably penetrating through said host tube frame in such a manner said pivot joint is adapted for transversely affixing on said host tube frame and pivotally connecting with said guest tube frame in such rotatably movable manner.

2. A pivot joint for foldable furniture which is constructed with a plurality of host and guest tube frames, wherein said pivot joint has a tail portion and a head portion securely affixed thereto, said head portion of the pivot joint having at least an engaging slot for pivotally connecting said guest tube frame and said tail portion of the pivot joint adapted for connecting to said foldable furniture in such a manner that said guest tube frame is adapted to rotate in various directions with respect to said foldable furniture, wherein said head portion of said pivot joint having a U shape comprises a supporting panel and a pair of parallel supporting walls integrally and upwardly extended therefrom wherein said engaging slot is defined between said two supporting walls such that an end portion of said guest tube frame is pivotally connected between said two supporting walls by means of an axle; wherein said tail portion comprises a shaft body affixed on said supporting panel of said head portion, wherein said shaft body is adapted for coaxially and rotatably affixing on said host tube frame, wherein said host tube frame has a hollow body which has a diameter slightly larger than said tail portion of said pivot joint in such a manner said shaft body of said tail portion thereof is fittingly inserted into said host tube frame at one end thereof in such rotatably movable manner.

3. A pivot joint for foldable furniture which is constructed with a plurality of host and guest tube frames, wherein said pivot joint has a tail portion and a head portion securely affixed thereto, said head portion of the pivot joint having at least an engaging slot for pivotally connecting said guest tube frame and said tail portion of the pivot joint adapted for connecting to said foldable furniture in such a manner that said guest tube frame is adapted to rotate in various directions with respect to said foldable furniture; wherein said head portion of said pivot joint having a U shape comprises a supporting panel and a pair of parallel supporting walls integrally and upwardly extended therefrom wherein said engaging slot is defined between said two supporting walls such that an end portion of said guest tube frame is pivotally connected between said two supporting walls by means of an axle; wherein said tail portion of said pivot joint is adapted for securely affixing on a frame joint of said folding furniture wherein said tail portion is vertically affixed on said frame joint such that said guest tube frame pivotally connected to said head portion is adapted for increasing a rotating angle thereof in order to construct a better extension of said foldable furniture.

4. A pivot joint for foldable furniture which is constructed with a plurality of host and guest tube frames, wherein said pivot joint has a tail portion and a head portion securely affixed thereto, said head portion of the pivot joint having at least an engaging slot for pivotally connecting said guest tube frame and said tail portion of the pivot joint adapted for connecting to said foldable furniture in such a manner that said guest tube frame is adapted to rotate in various directions with respect to said foldable furniture; wherein said head portion of said pivot joint having a W shape comprises a supporting panel and three parallel supporting walls integrally and upwardly extended therefrom wherein two engaging slots are defined between said three supporting walls respectively such that two guest tube frames are pivotally connected between said three supporting walls and along said two engaging slots respectively in such rotatably movable manner by means of an axle; wherein said tail portion, which is a rivet, comprises a shaft body securely affixed on said supporting panel of said head portion, wherein said shaft body is adapted for transversely and rotatably penetrating through said host tube frame in such a manner said pivot joint is adapted for transversely affixing on said host tube frame and pivotally connecting with said guest tube frame in such rotatably movable manner.

5. A pivot joint for foldable furniture which is constructed with a plurality of host and guest tube frames, wherein said pivot joint has a tail portion and a head portion securely affixed thereto, said head portion of the pivot joint having at least an engaging slot for pivotally connecting said guest tube frame and said tail portion of the pivot joint adapted for connecting to said foldable furniture in such a manner that said guest tube frame is adapted to rotate in various directions with respect to said foldable furniture, wherein said head portion of said pivot joint having a W shape comprises a supporting panel and three parallel supporting walls integrally and upwardly extended therefrom wherein two engaging slots are defined between said three supporting walls respectively such that two guest tube frames are pivotally connected between said three supporting walls and along said two engaging slots respectively in such rotatably movable manner by means of an axle; wherein said tail portion comprises a shaft body securely affixed on said supporting panel of said head portion, wherein said shaft body is adapted for coaxially and rotatably affixing on said host tube frame, wherein said host tube frame has a hollow body which has a diameter slightly larger than said tail portion of said pivot joint in such a manner said shaft body of said tail portion thereof is fittingly inserted into said host tube frame at one end thereof in such rotatably movable manner.

6. A pivot joint for foldable furniture which is constructed with a plurality of host and guest tube frames, wherein said pivot joint has a tail portion and a head portion securely affixed thereto, said head portion of the pivot joint having at least an engaging slot for pivotally connecting said guest tube frame and said tail portion of the pivot joint adapted for connecting to said foldable furniture in such a manner that said guest tube frame is adapted to rotate in various directions with respect to said foldable furniture, wherein said head portion of said pivot joint having a W shape comprises a supporting panel and three parallel supporting walls integrally and upwardly extended therefrom wherein two engaging slots are defined between said three supporting walls respectively such that two guest tube frames are pivotally connected between said three supporting walls and along said two engaging slots respectively in such rotatably movable manner by means of an axle; wherein said tail portion of said pivot joint is adapted for securely affixing on a frame joint of said folding furniture wherein said tail portion is vertically affixed on said frame joint such that said guest tube frame pivotally connected to said head portion is adapted for increasing a rotating angle thereof in order to construct a better extension of said foldable furniture.

7. A pivot joint for foldable furniture which is constructed with a plurality of host and guest tube frames, wherein said pivot joint has a tail portion and a head portion securely affixed thereto, said head portion of the pivot joint having at least an engaging slot for pivotally connecting said guest tube frame and said tail portion of the pivot joint adapted for connecting to said foldable furniture in such a manner that said guest tube frame is adapted to rotate in various directions with respect to said foldable furniture, wherein said head portion of said pivot joint has two outer supporting walls, an intermediate supporting wall parallel to said two outer supporting walls, and two supporting panels integrally connected between said outer supporting walls and said intermediate supporting wall to form said S shape structural head portion wherein two opposed engaging slots are defined between said outer supporting wall and said intermediate supporting wall for pivotally connecting two guest tube frames along said two engaging slots respectively.

8. A pivot joint, as recited in claim 7, having two said tail portions, which are rivets, each comprises a shaft body securely affixed on each said supporting panel of said head portion, wherein each said shaft body is adapted for transversely and rotatably penetrating through said host tube frame in such a manner said tail portions of said pivot joint are adapted for transversely affixing on two said host tube frame respectively in such rotatably movable manner.

9. A pivot joint, as recited in claim 7, having two said tail portions, for coaxially and rotatably affixing on two said host tube frame, each comprises a shaft body securely affixed on each said supporting panel of said head portion, wherein said host tube frame has a hollow body which has a diameter slightly larger than said tail portion of said pivot joint.

* * * * *